US006745918B2

(12) United States Patent
Greene

(10) Patent No.: US 6,745,918 B2
(45) Date of Patent: Jun. 8, 2004

(54) ELEVATING DISPENSER FOR CANISTER

(76) Inventor: Roger Lee Greene, 5290 Ponon Valley Rd., Colorado Springs, CO (US) 80919

( * ) Notice: Subject to any disclaimer, the term of this patent is extended or adjusted under 35 U.S.C. 154(b) by 71 days.

(21) Appl. No.: 10/244,237

(22) Filed: Sep. 16, 2002

(65) Prior Publication Data

US 2004/0050859 A1 Mar. 18, 2004

(51) Int. Cl.[7] ..... B65H 1/00; B65H 59/00; B65H 1/08; G07F 11/16; B65D 75/00

(52) U.S. Cl. ..... 221/198; 221/279; 221/312 R; 206/804; 426/115

(58) Field of Search ..... 221/198, 279, 221/312 R, 312 B, 312 C; 206/804; 426/115

(56) References Cited

U.S. PATENT DOCUMENTS 3,680,736 A * 8/1972 Viessmann ..... 221/14
4,697,707 A 10/1987 Engdahl
5,242,077 A 9/1993 Smith et al.
5,337,915 A * 8/1994 Hall, Jr. ..... 220/495.11
5,673,611 A 10/1997 Tieman
5,918,535 A 7/1999 Moreau
6,070,759 A 6/2000 Bridge et al.
6,092,717 A * 7/2000 Lowry ..... 229/120.03
6,206,279 B1 3/2001 Countee
6,227,441 B1 5/2001 Sagel et al.
2002/0168453 A1 * 11/2002 McCutchan ..... 426/115

* cited by examiner

*Primary Examiner*—Donald P. Walsh
*Assistant Examiner*—Kenneth W Bower

(57) ABSTRACT

An elevating dispenser to lift and suspend fragile foodstuffs from within an upright canister for serving. A column of wafers (13) rest on an elevating dispenser (10) inside a canister (11). When wafers have been removed to the point that they are no longer easily obtainable from the canister aperture, the user lifts the dispenser and engages notches (10*c*) integral to the dispenser on the canister rim (11*b*), thus suspending wafers nearer the canister aperture to make them more easily obtainable.

4 Claims, 6 Drawing Sheets

ELEVATING DISPENSER FOR CANISTER

CROSS-REFERRENCE TO RELATED APPLICATIONS

Not applicable.

BACKGROUND OF THE INVENTION

1. Field of Invention

This invention relates to canisters, specifically to the use of a canister as consumer packaging for fragile, wafer-like foodstuffs.

2. Discussion of Prior Art

Use of a canister as a food container has many desirable benefits. A canister is strong, compact, and inexpensive. Use of a canister for storage of flours, rice, uncooked pasta, and other bulk goods is the traditional usage. However, a canister can also be of great benefit to ship and store fragile foodstuffs such as uniformly sized and molded snacks or any fragile wafer-like food or cookie.

The limitation of a canister for prepared wafer-like foods such as crisps or cookies is that its contents are reachable only as far as a finger-length. Beyond that point, the canister must be tilted or inverted so that the product begins to slide out. When the desired amount has been emptied from the canister, the canister is returned to an upright position. During the tipping and righting process, the contents slide back and forth, leaving them disheveled, broken, and chipped. If a canister holds several servings, the appearance and integrity of the product is greatly diminished by the last few servings. Additionally, when tilting or inverting the canister, messy crumbs and broken pieces are unintentionally dispensed along with whole product. If the contents of a canister are emptied into a bowl for serving, product identity is lost and unused portions must be dropped back into the canister.

The prior art shows only one attempt to dispense edible wafers from a canister. U.S. Pat. No. 6,070,759 to Bridge and Hill (1998, shows a dispensing lid on a canister. Theoretically, the wafers stay in position and queue properly at the lid to sift out one wafer at a time. The patent abstract indicates that the product is dispensed by inverting and tilting the container. While the dispenser lid can regulate the quantity of wafers dispensed, the remaining product is still susceptible to the range and type of motion that causes the product to crumble and break.

U.S. Pat. No. 5,918,535 to Moreau (1997, shows a basket for a cooking vessel that hooks via a device to the vessel rim. It is variably adjustable by means of an opposing peg inserted into any one of multiple perforations in the basket. The basket can then be suspended from the cooking media and drained. While the device itself does not perform any lifting function and the purpose and use of the device is considerably different from the current invention, it is cited due to the means of temporary attachment of an element on a vessel rim.

U.S. Pat. No. 6,227,441 to Sagel and Croft (1998, shows a flexible bag used in conjunction with a rigid sleeve. The identified use of the invention is a container for edible chips. The feature of the packaging is the ability to press in the box corners at intervals to stabilize product movement. The device does not dispense or otherwise alter the tilt and inversion of the packaging to obtain product.

U.S. Pat. No. 5,242,077 to Smith and Klemme (1992, shows a removable paper disk friction fit into a container to divide or restrain levels of product. While the disk may retain layers of product from motion, it does not serve any function as to the dispensing of product. Additionally the canister diameter would have to be large enough for a hand to enter to remove the disk.

U.S. Pat. No. 6,206,279 to Countee (1998, shows a box container that can be manipulated on folding features to accommodate a hand entering the container to retrieve bulk snack foods. It is cited as a device intended to eliminate the undesirable aspect of the need to tilt or invert a container to retrieve product.

U.S. Pat. No. 5,673,611 to Tieman (1997, shows a sling like device for removal of food from a slow-cooker.

U.S. Pat. No. 4,697,707 to Engdahl (1987, shows a container for fragile foods that supports its shape at stress points to prevent fractures.

The prior art shows a variety of devices to divide, portion, or access prepared foodstuffs. Two examples show a retrieval aid for vertical lifting and draining of food from cooking media. The prior art does not show a means of dispensing food from a canister without tilt or inversion.

SUMMARY

The elevating dispenser for canister of the present invention utilizes a sling, integral with the canister packaging to cradle and support a column of wafers. As product is diminished, the sling can be raised. A novel configuration allows the sling to temporarily attach to the canister rim at intervals in order to suspend product above or near the canister opening for easy reach. The present invention will enable an ease of use and satisfaction of product quality, display, and appearance substantially greater than inverting a canister to dispense product.

OBJECTS AND ADVANTAGES

Accordingly, the objects and advantages of the elevating dispenser for canister described in my above patent, several other advantages of the present invention are:

a) to provide a dispensing means integral with packaging.
b) to provide a means of reducing breakage by eliminating tilt and inversion of a canister to obtain product.
c) to provide a means whereby only a simple pinching motion of a finger and thumb are required to remove product that is elevated from within a canister.
d) to provide a means whereby crumbs remain in the bottom of a canister and are not dispensed with whole product.
e) to provide a means whereby wafers packed in a canister are held more snuggly to further reduce breakage due to shipping and handling.
f) to provide an inexpensive and simple packaging solution.
g) to provide a unique and marketable packaging feature in the marketplace.
h) to provide a serving and display means of product in its original packaging for greater brand recognition.
i) to provide a more convenient way of obtaining wafers whereby the user may be inclined to consume more product.
j) to provide a more appealing package and product appearance whereby the user may be enticed to consume more product.
k) to provide an additional benefit of an extra surface area suitable for print and graphic advertising of same or complementary product.
l) to provide an additional benefit of an extra surface area where interesting trivia or pop-culture phenomena can be displayed for target market interest and enjoyment.

m) to provide an additional benefit of a concealed surface on sealed product for chance-type contests, sweepstakes, or games.

n) to provide an additional benefit of a concealed surface on sealed product to use for coupon or discount promotion for same or complementary product.

o) to provide an additional benefit of a dispenser capable of supporting a retainer tab feature to secure product during canister handling.

DRAWING FIGURES

In the drawings, closely related figures have the same number, but different alphabetic suffixes.

Figure 1:
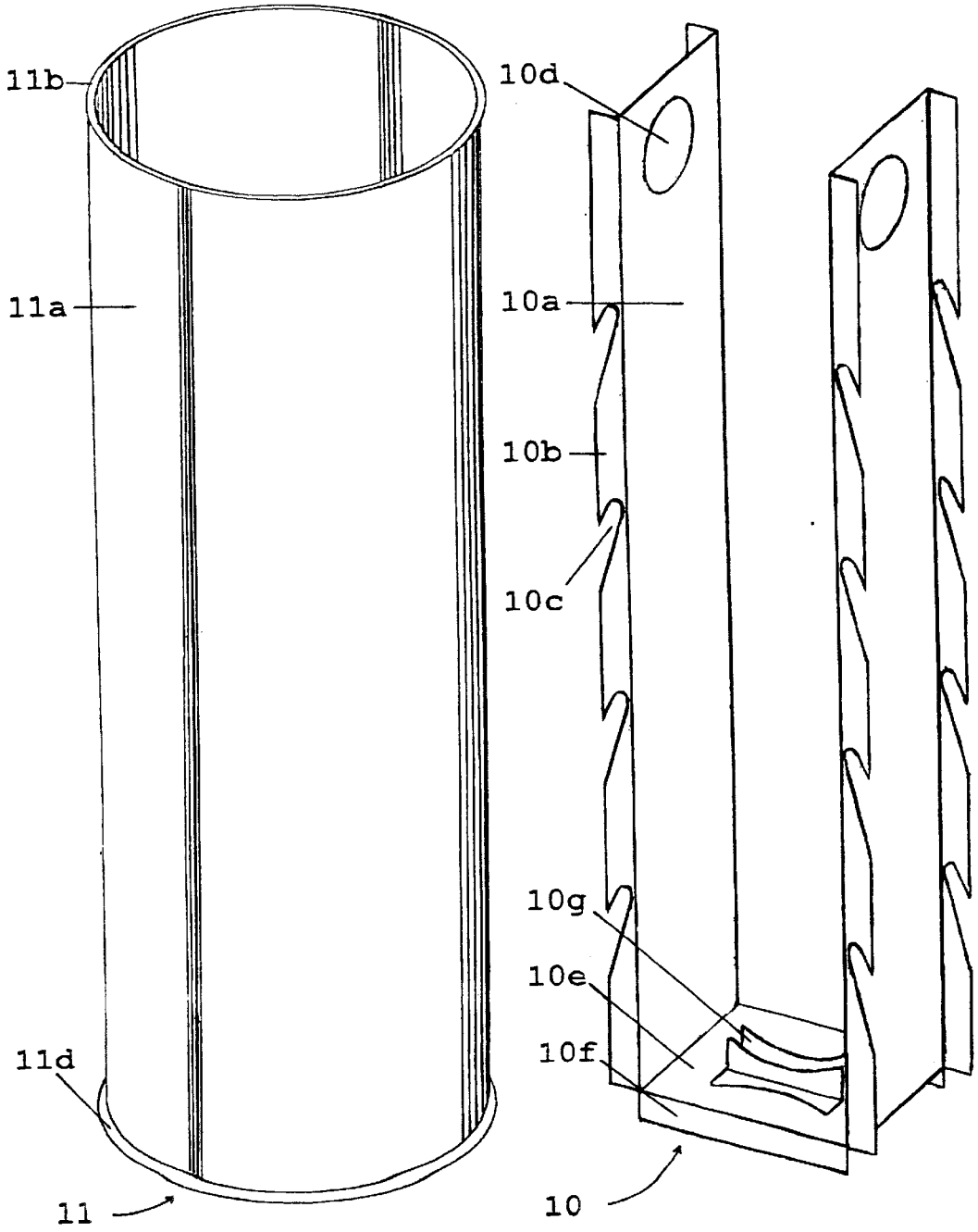
FIG. 1 shows a side view of a canister and the preferred embodiment of the elevating dispenser side-by-side.

| REFERENCE NUMERALS IN DRAWINGS | |
|---|---|
| 10 | elevating dispenser |
| 10a | vertical member |
| 10b | notched tab |
| 10c | notch |
| 10d | finger hole |
| 10e | base support |
| 10f | base stand-off tab |
| 10g | cradle tab |
| 10h | retainer tab |
| 10i | retainer tab score-line |
| 10j | rigid angle |
| 11 | canister |
| 11a | canister tube |
| 11b | canister rim |
| 11c | canister cap |
| 11d | canister bottom |
| 12 | formed wafer |
| 13 | flat wafer |

DETAILED DESCRIPTION

Preferred Embodiment—FIGS. 1–37

The preferred embodiment of the present invention is illustrated in FIG. 1, a side view of the dispenser and a canister side-by-side. Canister 11 is comprised of canister tube 11*a* which terminates at the top with canister rim 11*b* and at the bottom with canister bottom 11*d*. Elevating dispenser 10 is comprised of vertical member 10*a* which extends upward from opposite sides of base support 10*e*. Notched tab 10*b* extends back from vertical member 10*a*along both vertical edges. Notch 10*c* is located at intervals. along notched tab 10*b*. Finger hole 10*d* is located near the top of vertical member 10*a*. Base stand-off tab 10*f* extends down from the remaining opposite edges of base support 10*e*. Cradle tabs 10*g* extend up from base support 10*e*.

Figure 2:
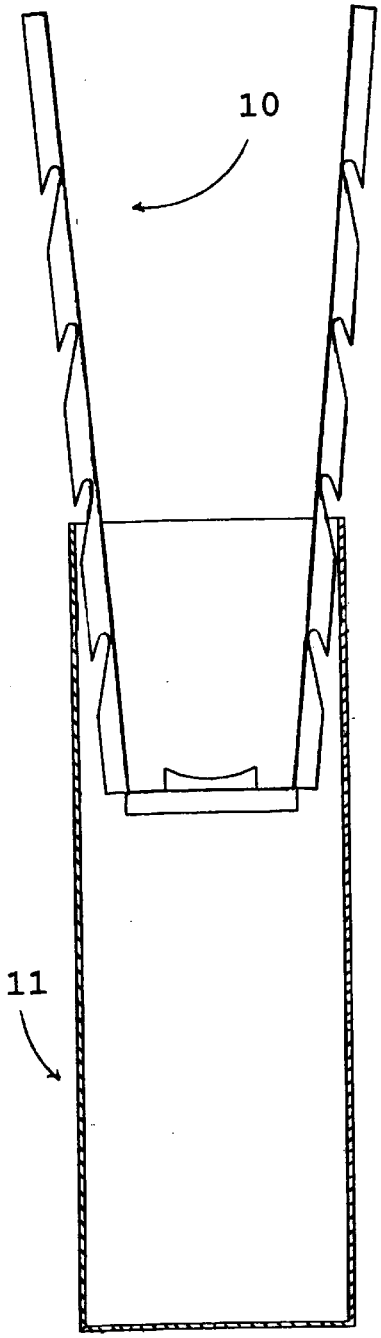
FIG. 2 shows a side view of the preferred embodiment partially inserted in a canister.

In FIG. 2, elevating dispenser 10 is shown partially inserted into canister 11.

Figure 3:
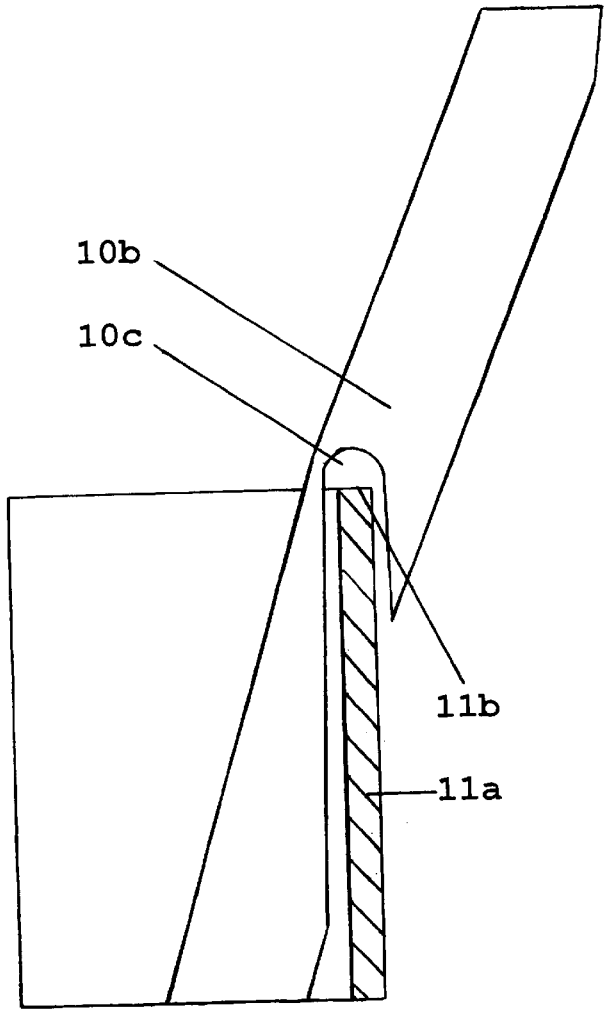
FIG. 3 shows a cut-away side detail of the preferred embodiment notch positioned on a canister rim.

In FIG. 3, a detail, notched tab 10*b* protrudes from canister tube 11*a*. Notch 10*c* sits on canister rim 11*b*.

Figure 4:
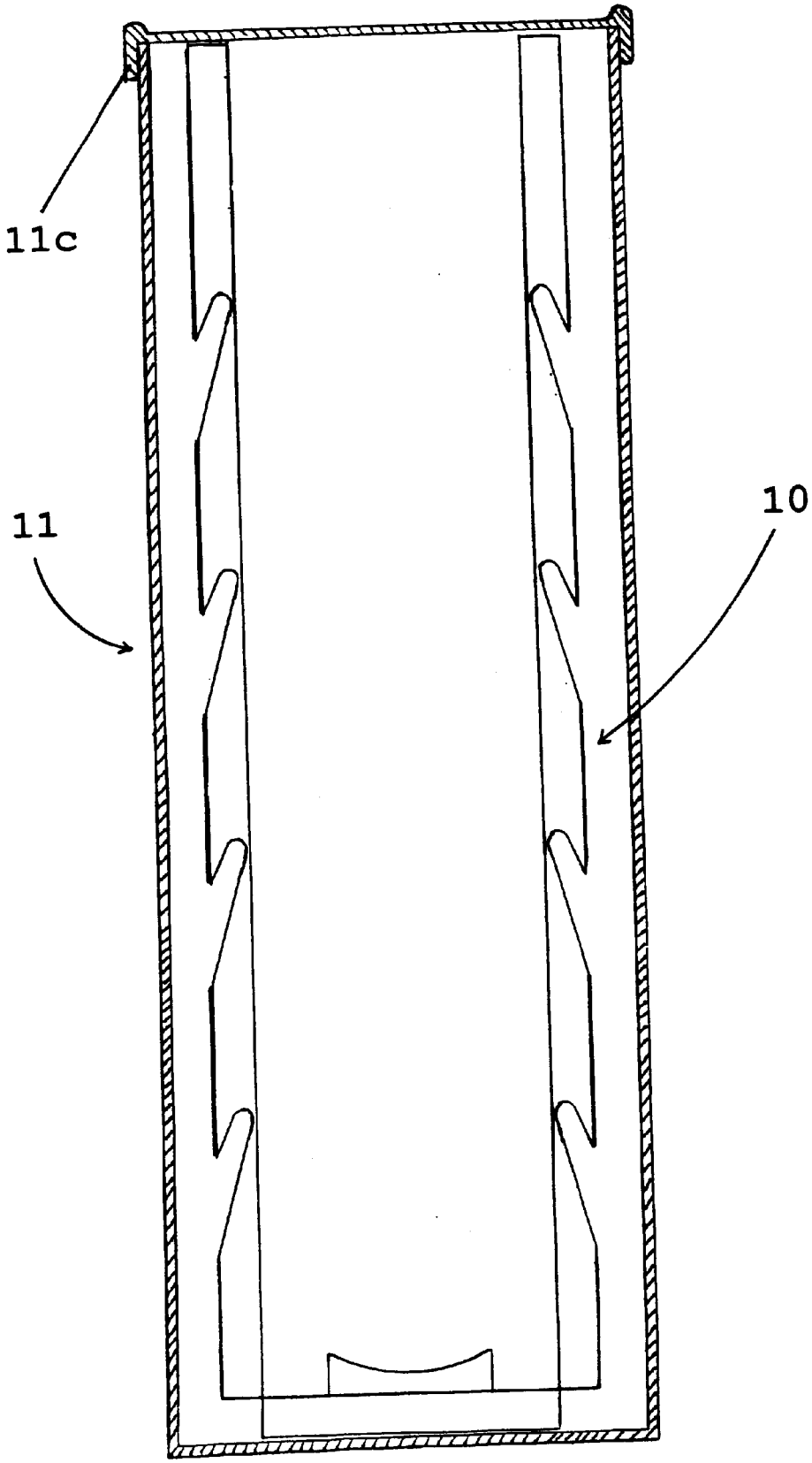
FIG. 4 shows a cut-away side view of the preferred embodiment in a sealed canister.

FIG. 4 shows elevating dispenser 10 completely inside canister 11. Canister cap 11*c* seals top of canister 11.

Figure 5:
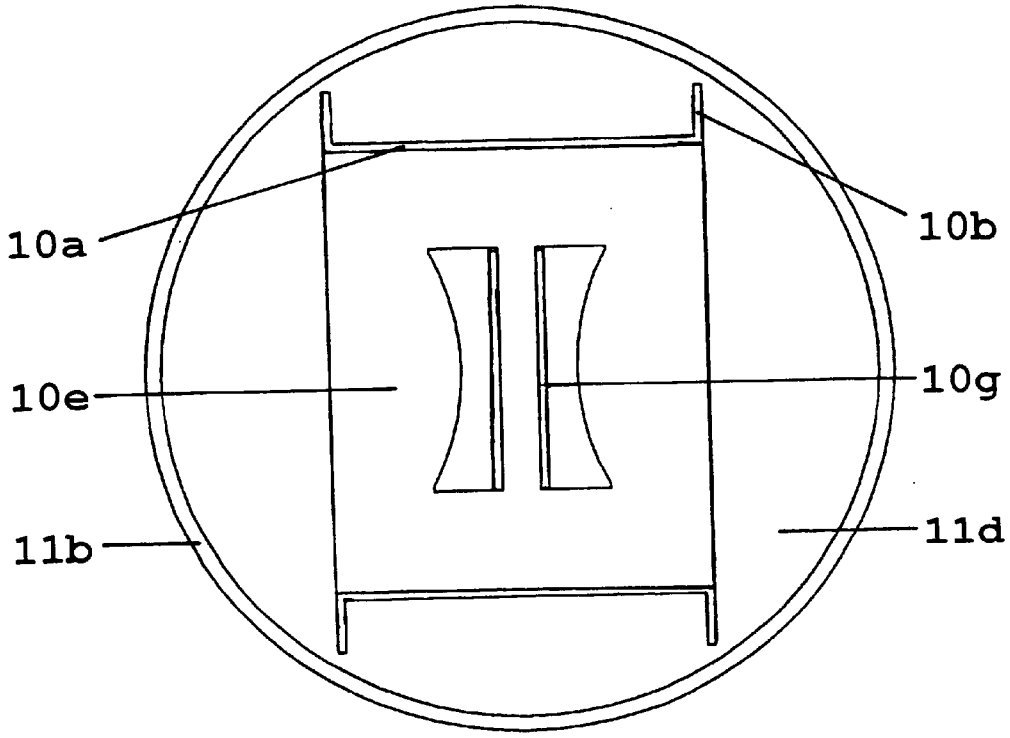
FIG. 5 shows a top view of the preferred embodiment in a canister.

In FIG. 5, a top view, elevating dispenser 10 is inside canister 11. Canister rim 11*b* encircles elevating dispenser 10. Base support 10*e* partially obscures canister bottom 11*d*. Cradle tabs 10*g* stand up from base support 10*e*. Vertical member 10*a* stands up from base support 10*e* inside canister 11. Notched tab 10*b* extends back from vertical member 10*a*.

Figure 6:
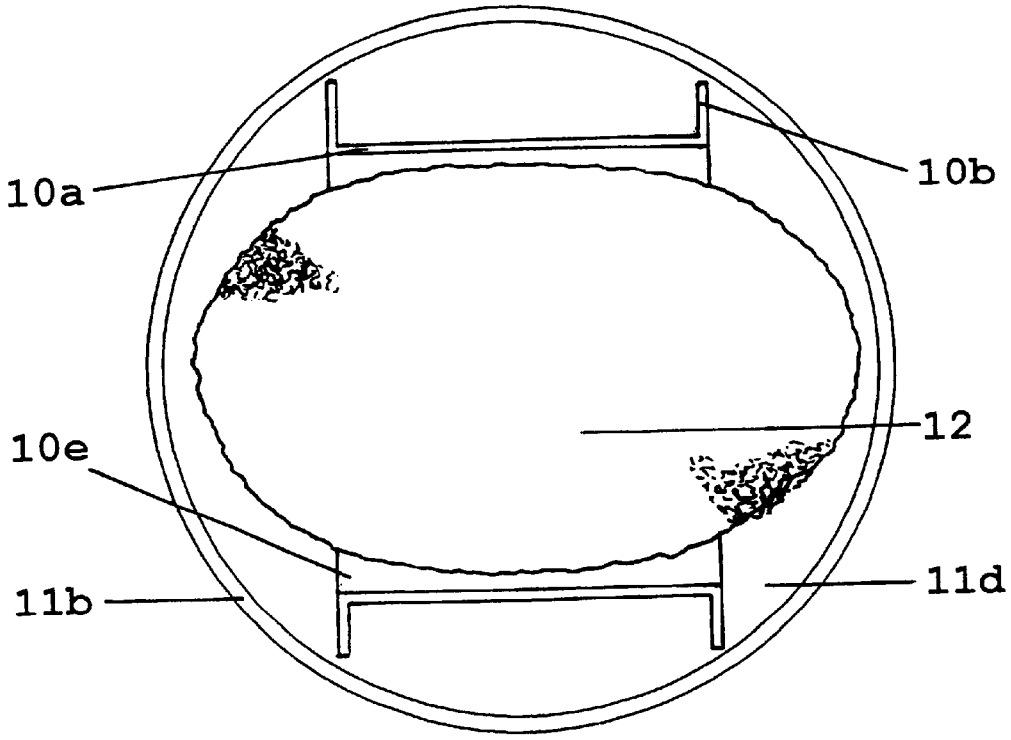
FIG. 6 shows a top view of the preferred embodiment in a canister with a formed wafer positioned on the base.

FIG. 6 shows formed wafer 12 on base support 10*e* positioned between vertical members 10*a*.

Figure 7:
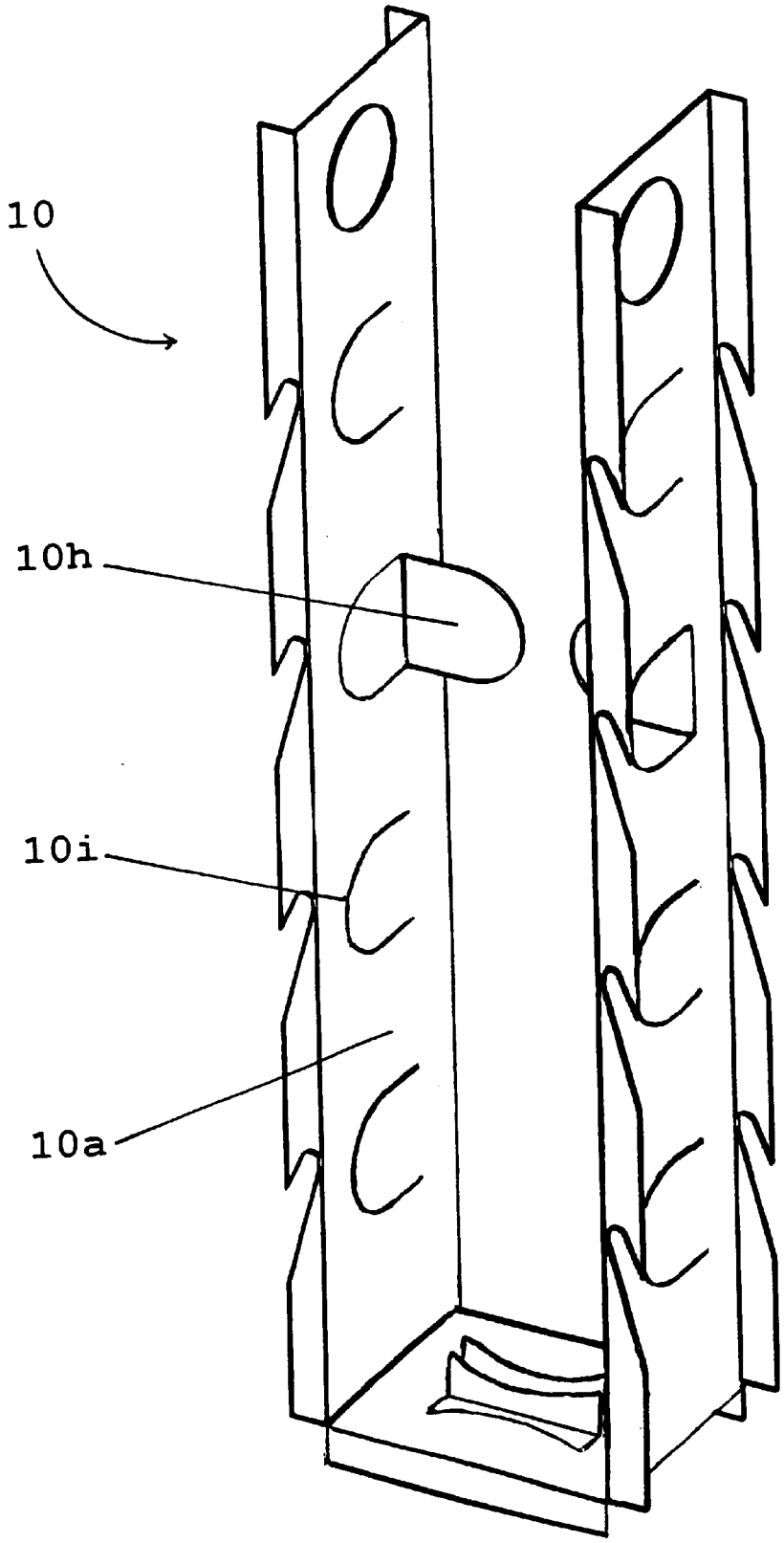
FIG. 7 shows an additional retainer tab feature incorporated with the preferred embodiment.

FIG. 7 shows retainer tabs 10*h* bent in from the surface of vertical member 10*a*. Score-lines 10*i* for retainer tabs 10*h* are located at intervals along the surface of vertical member 10*a*.

Operation—FIGS. 1–7

Preferred Embodiment

In FIG. 1, elevating dispenser 10 is shown adjacent and in same scale to canister 11. Elevating dispenser 10 spans from canister bottom 11*d* to canister rim 11*b*. Finger hole 10*d* on vertical member 10*a* is graspable from the top aperture of canister 11. Vertical member 10*a* extends downward to base support 10*e* in such manner that the entire contents of canister tube 11*a* rests on base support 10*e* and is removable by lifting on finger holes 10*d* of vertical members 10*a*.

Notch 10*c* is located at intervals along notched tab 10*b*. Notched tab 10*b* extends back from both sides of vertical member 10*a* to provide a protrusion capable of spanning canister rim 11*b* with notch 10*c*. As product is removed from canister 11 and becomes difficult to reach, the user grasps finger holes 10*d* on elevating dispenser 10 and lifts (FIG. 2. When elevating dispenser 10 is raised to the point where next subsequent notch 10*c* is slightly above canister rim 11*b*, the user flexes vertical member 10*a* outward from canister 11 with a slight bending motion to engage notch 10*c* on canister rim 11*b*. Elevating dispenser 10 is then lowered until notch 10*c* is secured on canister rim 11*b* (FIG. 3. The user may then easily reach and grasp product that has been elevated to a convenient. serving height. The spacing of notches 10*c* is incremental so that the user may continue to elevate as product level diminishes until canister 11 has been emptied of product. Notch 10*c* is depicted as a uniform configuration in the drawings to simplify conception. Slight modification may be necessary to engage canister rim 11*b* more accurately at specific intervals. Manipulation of dispenser vertical member 10*a* for positioning notches 10*c* on canister rim 11*b* will require use of a semi-rigid material. The preferred embodiment is conceived of as a stamped and folded sheet good.

When the desired product has been removed from elevating dispenser 10, vertical members 10*a* are lifted to raise notch 10*c* from resting position on canister rim 11*b*. The user then holds in vertical members 10*a* so that notched tab 10*b* clears canister rim 11*b* and slides down within canister tube 11*a*. Canister cap 11*c* is then applied to canister rim 11*b* to seal canister 11 (FIG. 4).

FIGS. 5 and 6 show top views of elevating dispenser 10 inside canister 11. FIG. 5 shows empty cradle tabs 10g.

FIG. 6 shows formed wafer 12 positioned on base support 10*e* to provide an idea of size and placement of product on the preferred embodiment.

FIG. 7 shows retainer tab 10*h* bent inward from vertical member 10*a*. Score-lines 10*i* for retainer tabs 10*h* are depicted at intervals on vertical members 10*a*. Retainer tab 10*h* may be pushed in to help keep product in the preferred position should canister 11 be stored or held in a position other than upright.

Figure 8:
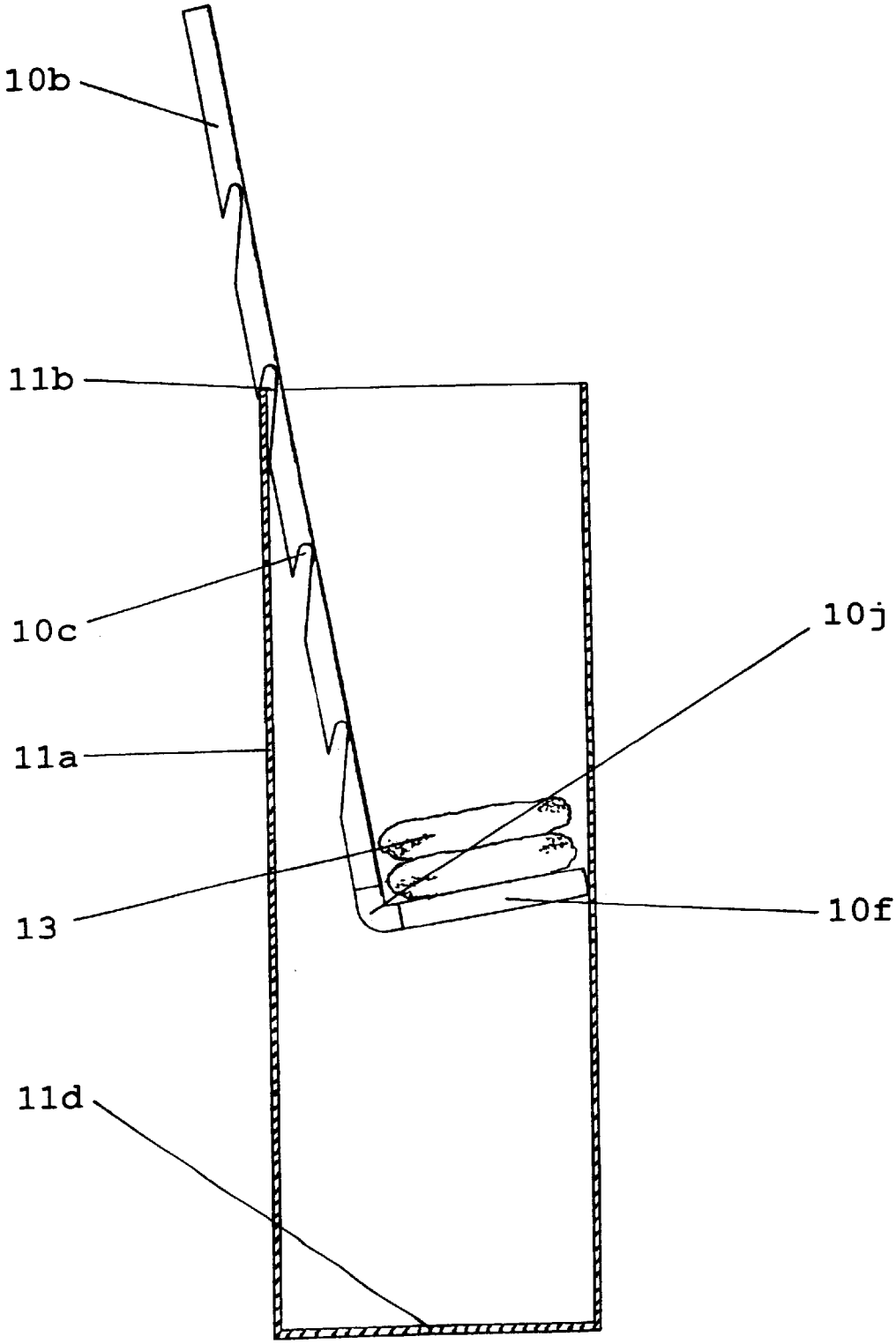
FIG. 8 shows a cut-away side view of the first alternative embodiment partially inserted in a canister.

Description—FIG. 8

First Alternative Embodiment

Dispenser 10, is partia11y inserted in canister 11. Base stand-off tab 10*f* is affixed to notched tab 10*b* by means of rigid angle 10*j*. Notch 10*c* of notched tab 10*b* is positioned on canister rim 11*b*. Flat wafer 13 is suspended on dispenser 10.

Operation—FIG. 8

First Alternative Embodiment

This embodiment utilizes a single vertical extension means for operation by a single hand. Rigid angle 10*j* adjoins notched tab 10*b* and base stand-off tab 10*f* at a 90 degree angle to support flat wafer 13. Notch 10*c* is hooked on canister rim 11*b*. This embodiment will require more rigid construction materials than the preferred embodiment.

Conclusion, Ramification, And Scope

The advantages of the elevating dispenser for canister are many. It is a low-cost means of lifting, and dispensing fragile wafer-like product from an upright canister. It can provide more product stability to reduce breakage during shipping. Product remains undisturbed and in its preferred position throughout serving and storage. The dispenser is convenient and ergonomically simple to use. It provides a marketable advantage not only by improved quality and presentation but also by way of novelty to an otherwise bland method of packaging.

As a secondary benefit, the surfaces of the dispenser may be suitable for additional printed or graphic product information, pop culture phenomena, holiday, seasonal, or trivia to attract a particular market segment. The surface area may also be used for promotional advertising to generate additional sales of same or complementary product.

The elevating dispenser is not visible in a sealed opaque canister, making it well suited to coupons, prizes, games, or contests wherein the benefit is intended to be secret or unavailable prior to opening of the package or consumption of the product.

Additional features such as push-in retaining tabs located on the uprights can help product stay secure during rough handling and storage.

The dispenser may be made of any cardboard, plastic, metallic foil or combination of economical and suitable materials. The physical shape and style may vary for a particular esthetic effect or for differentiation of canister shape, width, height, or geometric composition. The nature of the foodstuff expected to be suitable for the elevating dispenser includes but is not limited to: any cookie, cracker, crisp, chip, confection, jerky, or lozenge. The physical characteristics of the foodstuff may include but not be limited to: flat or formed wafers suitable for stacking or nesting in a vertical fashion.

Actual means of incremental and temporary attachment to the canister may consist of, but not be limited to: the notch means depicted in this patent, temporary adhesives, spring tension, friction, hook and loop, malleable materials or features, or any other method of temporary and suitable attachment of a movable and elevating feature within a canister.

Although the description above contains many specificities, these should not be construed as limiting the scope of the invention, but as merely providing illustration of some of the presently considered embodiment of the device. The scope of this invention should be determined by the appended claims and their legal equivalents, rather than by the examples given.

I claim:

1. An elevating dispenser for canister to lift wafers to a convenient level for serving from an upright canister comprising, an extension means that reaches the bottom of a canister and is accessible from the top aperture, a support means attached to the bottom of said extension means in such manner that it can support a column of wafers from underneath, an affixing means along said extension means whereby it can attach in a temporary and incremental manner to a canister, whereby, a column of nested or stacked wafers may be lifted and suspended within a vertical canister to raise wafers above or near the top aperture for serving.

2. The extension means of claim 1, wherein said extension means includes at least one vertical member that extends from the canister bottom and is graspable through the top aperture.

3. The support means of claim 1, wherein said support means includes a base support attached to said vertical member that can under gird and support a column of wafers while raised, lowered, or suspended by said vertical members.

4. The affixing means of claim 1, wherein said affixing means includes a notched tab configuration along the length of said vertical member with incrementally spaced notches that are capable of hooking onto a canister rim.

* * * * *